US009593662B2

(12) United States Patent
Stifel et al.

(10) Patent No.: US 9,593,662 B2
(45) Date of Patent: Mar. 14, 2017

(54) CORONA IGNITION DEVICE AND METHOD FOR PRODUCING AN IGNITION HEAD FOR A CORONA IGNITION DEVICE

(71) Applicant: BorgWarner BERU Systems GmbH, Ludwigsburg (DE)

(72) Inventors: Timo Stifel, Korntal-Münchingen (DE); Werner Niessner, Steinheim (DE); Helmut Müller, Hessigheim (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 448 days.

(21) Appl. No.: 14/055,496

(22) Filed: Oct. 16, 2013

(65) Prior Publication Data

US 2014/0116369 A1 May 1, 2014

(30) Foreign Application Priority Data

Oct. 29, 2012 (DE) ..... 10 2012 110 349
Nov. 20, 2012 (DE) ..... 10 2012 111 190

(51) Int. Cl.
*F02P 23/04* (2006.01)
*H01T 13/20* (2006.01)
*H01T 13/50* (2006.01)

(52) U.S. Cl.
CPC ..... *F02P 23/04* (2013.01); *H01T 13/20* (2013.01); *H01T 13/50* (2013.01); *Y10T 29/49231* (2015.01)

(58) Field of Classification Search
CPC .... F02P 3/01; F02P 9/007; F02P 13/00; F02P 15/04; F02P 15/08; F02P 23/04; F02P 23/045; H01T 13/20; H01T 13/50; H01T 13/54; H01T 19/00; H01T 21/02
USPC ... 123/143 B, 143 R, 145 R, 169 R, 169 EL, 123/169 CA, 169 DW, 169 MG, 606, 123/634; 313/136, 141–145
See application file for complete search history.

(56) References Cited

U.S. PATENT DOCUMENTS 8,776,751 B2 * 7/2014 Hampton ..... H01T 13/467 123/143 R
8,857,396 B2 * 10/2014 Giffels ..... H01T 13/50 123/169 R (Continued)

FOREIGN PATENT DOCUMENTS

DE 10 2010 062 279 A1 6/2012
DE 10 2010 045 175 A1 8/2012
WO WO 2011/130365 A1 10/2011

*Primary Examiner* — John Kwon
*Assistant Examiner* — Johnny H Hoang
(74) *Attorney, Agent, or Firm* — Bose McKinney & Evans LLP

(57) ABSTRACT

The invention relates to a corona ignition device for igniting fuel in a combustion chamber of an engine by means of a corona discharge, comprising an insulator, a center electrode, which plugs into the insulator and carries an ignition head having a plurality of ignition tips, a coil, which is connected to the center electrode, and a housing, which surrounds the coil and into which the insulator plugs, wherein the ignition head has main body formed from sheet metal. In accordance with the invention, the ignition tips consist of a different material compared to the main body and are fastened to a side face of the main body. The invention also relates to an ignition head for such a corona ignition device and to a method for production thereof.

18 Claims, 4 Drawing Sheets

(56) References Cited

U.S. PATENT DOCUMENTS

| | | | | |
|---|---|---|---|---|
| 2011/0247579 | A1 | 10/2011 | Hampton et al. | |
| 2012/0055434 | A1 | 3/2012 | Giffels et al. | |
| 2012/0056522 | A1* | 3/2012 | Giffels | H01T 13/20 313/136 |
| 2012/0199088 | A1* | 8/2012 | Burrows | F02P 9/007 123/143 B |
| 2012/0210968 | A1* | 8/2012 | Burrows | H01T 13/50 123/143 B |
| 2012/0279468 | A1* | 11/2012 | Burrows | H01T 13/50 123/143 B |
| 2013/0003251 | A1* | 1/2013 | Durham | H01T 13/50 361/253 |
| 2013/0049566 | A1* | 2/2013 | Burrows | F02P 23/04 313/141 |
| 2013/0155570 | A1* | 6/2013 | Stifel | H01T 13/44 361/263 |
| 2013/0340697 | A1* | 12/2013 | Burrows | H01T 13/50 123/146.5 R |
| 2014/0261270 | A1* | 9/2014 | Burrows | F02P 23/04 123/143 B |

* cited by examiner

CORONA IGNITION DEVICE AND METHOD FOR PRODUCING AN IGNITION HEAD FOR A CORONA IGNITION DEVICE

RELATED APPLICATIONS

This application claims priority to DE 10 2012 110 349.6, filed Oct. 29, 2012 and DE 10 2012 111 190.1, filed Nov. 20, 2012, both of which are incorporated herein by reference in their entireties.

BACKGROUND

The invention relates to a corona ignition device for igniting fuel in a combustion chamber of an engine by means of a corona discharge. Such corona ignition devices are generally known from DE 10 2010 045 175 A1. With this known corona ignition device, the center electrode carries an ignition head that has a plurality of ignition tips and is produced by cutting out from sheet metal.

It is known from WO 2011/130365 A1 to cover the ignition tips of such an ignition head with a wear-resistant layer and to thus increase the service life of the ignition head. The wear-resistant layer is applied to the upper side of the ignition head in the region of the ignition tips and may also be applied to the lower side of the ignition head by means of plating, powder coating or cathode-ray sputtering. Inter alia, platinum metals are mentioned as material for the wear-resistant layer.

SUMMARY

The present invention provides a way in which a wear-resistant ignition head of a corona ignition device can be manufactured economically.

In the case of a corona ignition device according to this disclosure, the ignition tips consist of a different material compared to the main body and can in some embodiments be fastened to a side face of the main body. Here, the side face is to be understood to mean any face that connects the upper side of the ignition head or of a sheet metal to the lower face. The side face is sometimes also referred to as a narrow side, lateral side or peripheral side.

Instead of cutting out the ignition head from sheet metal and then coating the upper side and lower side of the ignition tips with a wear-resistant material, as is known from WO 2011/130365 A1, the ignition head of the present invention is cut out from a semifinished product assembled from two different materials, specifically from a sheet metal that consists of a first material, for example steel or another base alloy of a transition metal, and at least one body formed from a second material, for example platinum metal, which is applied to an edge region, e.g., a side face of the sheet metal. The ignition tips of an ignition head according to this disclosure therefore have cut edges, that is to say edges that have been produced by cutting, for example laser cutting, stamping or spark erosion. Sharp edges of the ignition tips are advantageous for the formation of a corona discharge. The ignition tips are the end sections of radial protrusions of the ignition head, e.g., the end sections of wedge shaped protrusions.

In the case of an ignition head according to this disclosure, the ignition tips are fastened to a side face of the main body. The ignition tips can thus be produced completely from a wear-resistant material, for example from platinum metal. If the ignition tips, continuously from their upper side to their lower side, consist of a different material compared to the main body, a longer service life can be achieved than with ignition tips that have only one more or less thin layer formed from wear-resistant material and there beneath consist of less resistant material, such as steel.

Ignition heads can be produced economically by applying a second material to an edge region of a sheet metal formed from a first material and then cutting out an ignition head from the semifinished product, the main body of the ignition head consisting of the first material and the ignition tips of the ignition head being formed by the edge region of the semifinished product coated with the second material. The edge region may be a strip on the front side or on the rear side of a sheet metal. The edge region is preferably a side face of the sheet metal.

A second material, for example platinum metal, is preferably applied to at least one side face of a sheet metal consisting of a first material, for example steel or another base alloy of a transition metal, and an ignition head is then cut out from this sheet metal, for example by stamping, spark erosion or laser cutting. Here, the ignition tips are cut out from an edge region of the sheet metal, to the side face of which the second material has been applied. The main body of the ignition head then consists of the first material, and the ignition tips consist of the second material.

Since the ignition head with its ignition tips is cut out from a semifinished product, the ignition tips each have at least one cut edge. Cut edges are advantageous, since such sharp edges lead to locally increased field strengths and thus promote the creation of corona discharges. If, by contrast, a main body including ignition tips were cut out from a homogeneous sheet metal and then coated in the region of its ignition tips with a wear-resistant layer, edges of the main body would thus be rounded by the layer and the conditions for corona discharges would thus be worsened.

Each ignition tip preferably has a plurality of cut edges, for example two cut edges, which limit a wedge, e.g., enclose an acute angle in-between and run on the edge of the upper side or lower side. The two side faces of a wedge shaped ignition tip can converge in a further cut edge.

Corona discharges always form at tips, since this is where the electric field is greatest. Ignition tips are therefore the parts of ignition heads that are most affected by corona discharges. If the ignition tips are solidly of wear-resistant material, for example platinum metal or an alloy based on platinum metal, these have a longer service life than ignition tips that are only coated on their upper side and lower side with wear-resistant material.

Since the ignition tips may be rather short, only a small quantity of wear-resistant material is necessary for an ignition head according to the invention, and therefore cost-effective manufacture is possible, even with use of expensive platinum metals.

Platinum metals are sometimes also referred to as platinoids. A platinum metal is a metal in the platinum group, that is to say Ru, Rh, Pd, Os, Ir and Pt. Platinum metals and platinum metal base alloys, that is to say alloys that consist predominantly, preferably more than 80% by weight and particularly preferably more than 90% by weight, of platinum metal, are suitable as material for ignition tips.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
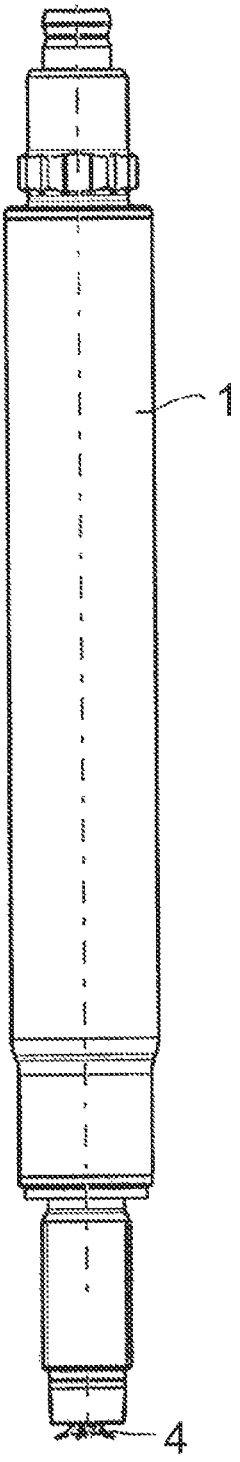
FIG. 1 shows a corona ignition device.
Figure 2:
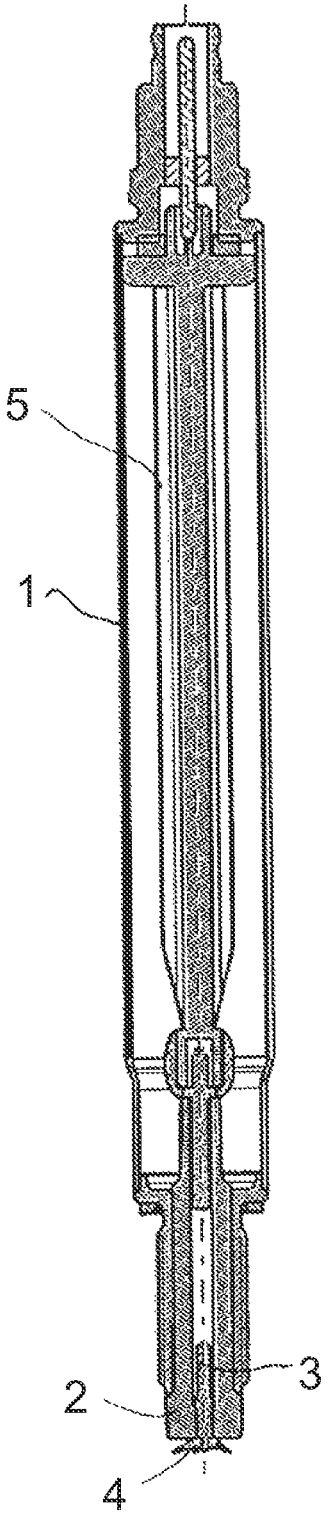
FIG. 2 shows a longitudinal section through FIG. 1.

The ignition device illustrated in FIGS. 1 and 2 generates a corona discharge for igniting fuels in a combustion chamber of an engine. The corona ignition device has a housing 1, which is closed at one end by an insulator 2. A center electrode 3, which carries an ignition head 4 having a plurality of ignition tips, is surrounded by the insulator 2. The ignition head 4 has several wedge shaped protrusions. The end of such a wedge shaped protrusion is called an ignition tip. The center electrode 3, the insulator 2 and the housing 1 form a capacitor, which is connected in series to a coil 5 that is connected to the center electrode 3. This capacitor and the coil 5 are part of an electric oscillating circuit, the excitation of which makes it possible for corona discharges to be produced at the ignition tips of the ignition head 4.

Figure 3:
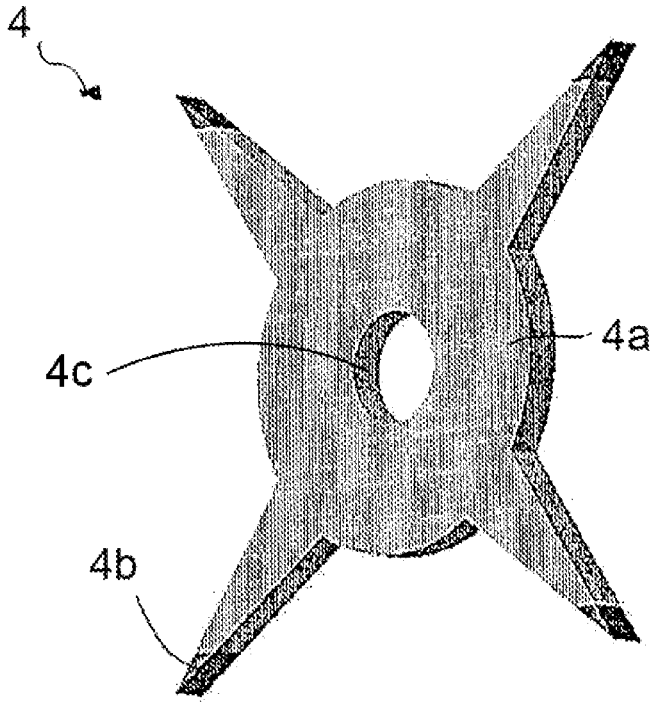
FIG. 3 shows an illustrative embodiment of an ignition head for a corona ignition device.
Figure 5:
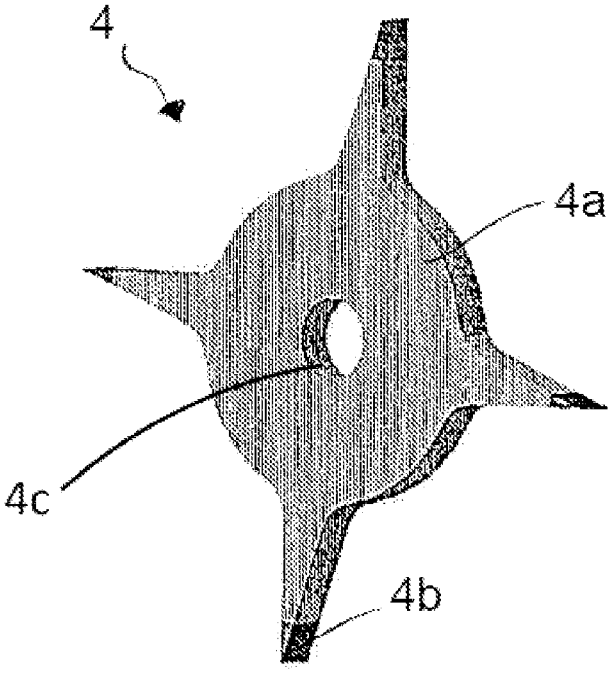
FIG. 5 shows a further illustrative embodiment of an ignition head.
Figure 7:
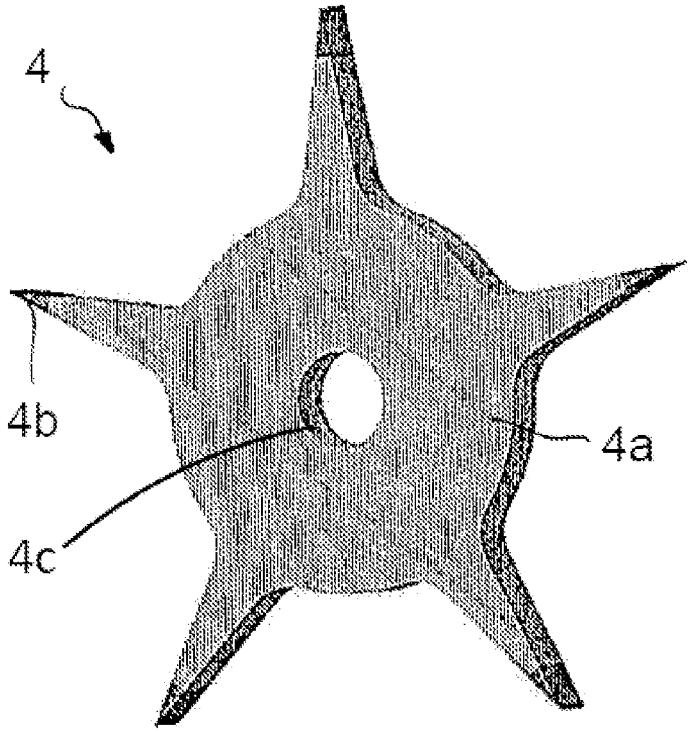
FIG. 7 shows a further illustrative embodiment of an ignition head.

Different illustrative embodiments of ignition heads 4 are illustrated in FIGS. 3, 5 and 7. The ignition heads 4 each have a main body 4*a* made of sheet metal, which, in its center, may have an aperture 4*c* for fastening on a center electrode of a corona ignition device, and ignition tips 4*b*. The main body 4*a* consists of a first material, for example steel or another base alloy of a transition metal, such as nickel. Ignition tips 4*b* made of another material are fastened to a side face of the main body 4*a*. A side face of the main body 4*a* is a face or side which connects the upper side illustrated in the figures with the lower side not visible in the figures. The material of the ignition tips 4*b* in the embodiments shown covers only the side face of the main body 4*a*, i.e. it covers no part of the upper or lower side. The upper side and lower side of the main body 4*a* are then completely free from the material of the ignition tips 4*b*.

The ignition tips 4*b* may consist for example of platinum metal or an alloy based on platinum metal. In particular, ignition tips made of platinum or iridium or an alloy based on platinum or iridium are well suited.

Figure 4:
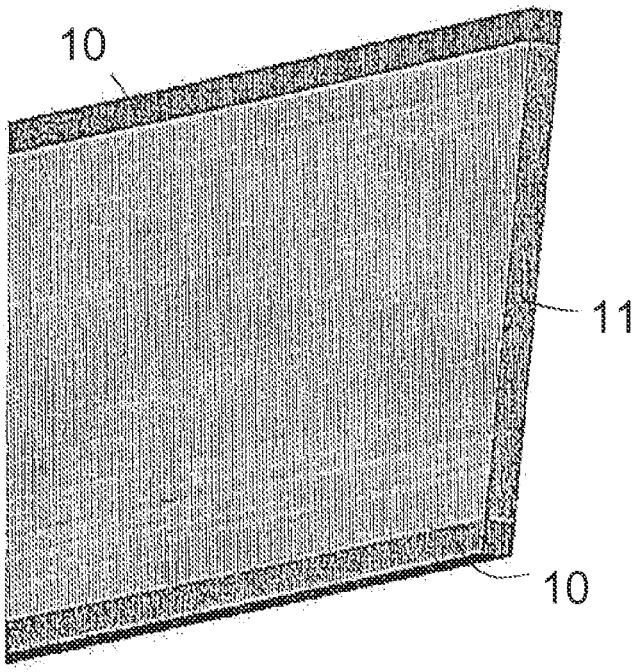
FIG. 4 shows a semifinished product for producing the ignition head shown in FIG. 3.
Figure 6:
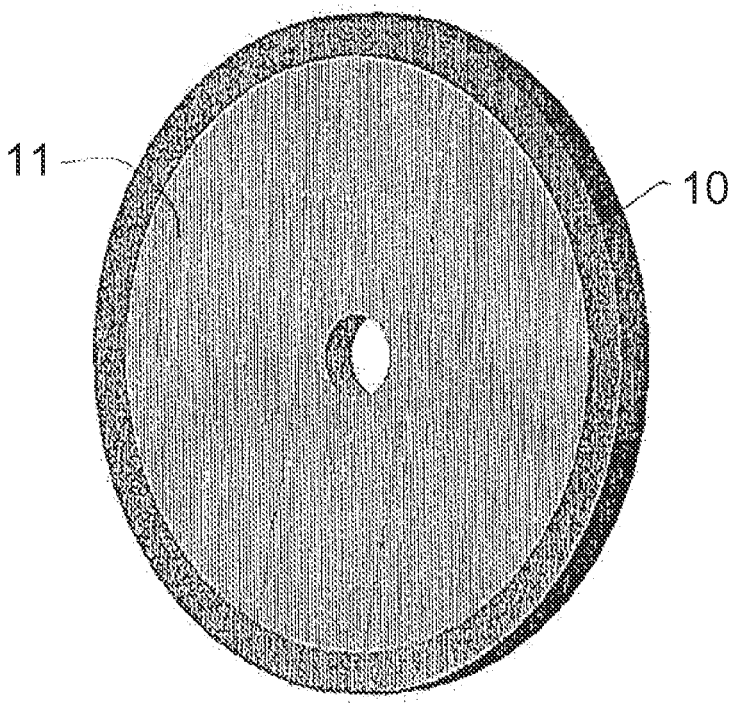
FIG. 6 shows a semifinished product for producing the ignition head shown in FIG. 5.
Figure 8:
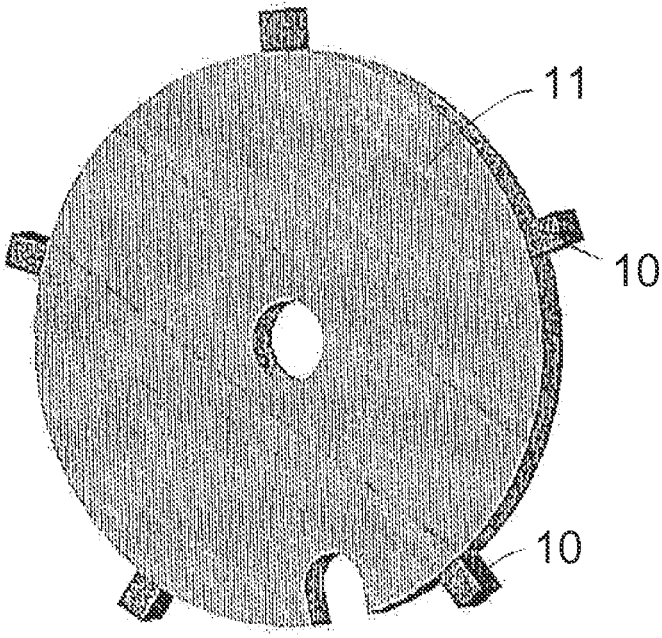
FIG. 8 shows a semifinished product for producing the ignition head shown in FIG. 7.

To produce the ignition heads, a second material is applied to a side face of a sheet metal formed from its first material. For example, a body made of a second material, preferably a sheet metal strip, can be attached to the side face of the sheet metal. An ignition head 4 is then cut out from the semifinished product formed by application of the second material, the ignition tips 4*b* of the ignition head consisting of the second material. Illustrative embodiments for semifinished products that have been produced by the attachment of second material to side faces of sheet metals made of first material are shown in FIGS. 4, 6 and 8.

Ignition heads 4 can be cut out from such a semifinished product, for example by being stamped out, by laser cutting, or by spark erosion. The ignition tips 4*b* then each have a plurality of cut edges. The ignition tips preferably have cut edges between their side faces and the upper side, between their side faces and the lower side, and between two side faces limiting a wedge shaped section, e.g., by enclosing an acute angle in-between. If one or more cutting planes run at an incline relative to a surface normal of the upper side of the semifinished product, one of the cut edges will be flatter and the other cut edge will be sharper edged. This may be advantageous, for example in order to create a particularly sharp cut edge between the upper side and one or more side faces, and therefore particularly favorable conditions for a corona discharge.

Instead of straight cut faces, zigzagged cut faces can also be used in order to create additional cut edges. For example, a zigzagged grooved contour can be cut out.

The second material can be fastened to the side face of the sheet metal, for example by welding. Besides other welding methods, weld cladding, in particular laser weld cladding, is suitable. A second material that is more noble than the first material can be applied to the side face in a simple manner by means of weld cladding. To reduce the amount of material, the weld cladding can be limited to the edge regions or side faces, from which an ignition tip is then formed by cutting out. Single-stage or multi-stage weld cladding can be used. In the case of weld cladding involving two or more stages, a material different from or the same as the material for the last layer can be used for the intermediate layer or intermediate layers. When applying an intermediate layer, the material can form an alloy with the underlying layer or the sheet metal. This alloy then forms the basis for the next step, such that the purity of the applied material increases towards the surface. Improved adhesion of the more wear-resistant material can thus be achieved.

The second material can also be attached to the side face of the sheet metal by roll cladding, for example laser roll cladding.

The attachment of a body formed from a second material to a side face of the sheet metal formed from a first material can be associated with considerable difficulties in the case of a thin sheet metal. It may therefore be advantageous to fasten the second material to the side face of a sheet metal which is thicker than the ignition head to be produced, and to then reduce the thickness of the semifinished product thus produced, for example by rolling. The second material can thus be fastened more easily to a side face of a sheet metal formed from the first material since the side face is then wider accordingly due to the greater thickness of the sheet metal. The thickness of the semifinished product thus produced from the first and the second material can then be reduced to the thickness desired for the ignition head.

In order to improve the adhesion of the second material to the first material, an intermediate layer can be provided between the first and the second material. Intermediate layers formed from a material that has an affinity both to the first material and to the second material are particularly well suited. For example, the intermediate layer may consist of an alloy of the first material with the second material.

The second material may be fastened for example as a strip 10 to a side face of the sheet metal 11. In the case of the semifinished product illustrated in FIG. 4, strips 10 formed from the second material are fastened to the longitudinal sides of a sheet metal strip formed from first material. In this way, a strip-shaped semifinished product is produced, from which an ignition head can then be cut out. Ignition heads having two to four ignition tips can then be cut out particularly well from such a strip-shaped semifinished product. Ignition heads having more than four ignition tips can also be cut out and may then be arranged at different distances from the center point of the ignition head.

The second material can also be attached in the form of a strip 10 to the side face of a plate-shaped sheet metal 11, as is illustrated by way of example in FIG. 6. The sheet metal plate may be a circular plate, as is illustrated in FIG. 6, or may also have a deviating shape. An advantage of a semifinished product in the form of a circular plate lies in the fact that ignition heads having any number of ignition tips can be cut out from such a semifinished product. It is possible without difficulty to cut out from such a semifinished product ignition heads having 4, 5, 6 or even more wedge shaped ignition tips starting radially from a center.

The side face of a sheet metal plate formed from the first material can be coated along its entire periphery with the second material, as is illustrated in FIG. 6. In order to save material, it is also possible to fasten bodies 10 formed from second material, for example plates, pins, cubes, spheres or hemispheres, to the side face of the sheet metal 11 only at some points. An example for such a semifinished product is illustrated in FIG. 8.

While exemplary embodiments have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A corona ignition device for igniting fuel in a combustion chamber of an engine by means of a corona discharge, comprising:

an insulator;

a center electrode surrounded by the insulator and carrying an ignition head having a plurality of ignition tips;

a coil connected to the center electrode;

a housing surrounding the coil and holding the insulator;

wherein the ignition head has a main body formed from sheet metal, the main body having a narrow side at an edge region, and wherein the ignition tips are formed of a different material than the main body and are fastened to the narrow side of the main body, wherein the ignition tips each have cut edges running continuously along the tip and an adjacent section of the main body, and whereby the ignition head is cut from a semifinished product assembled from two different materials.

2. The corona ignition device according to claim 1, wherein each ignition tip has two converging cut edges.

3. The corona ignition device according to claim 1, wherein the ignition tips are formed of a platinum metal or an alloy based on platinum metal.

4. The corona ignition device according to claim 1, further comprising an intermediate layer arranged between the ignition tips and the main body to improve the adhesion of the ignition tips to the main body.

5. The corona ignition device according to claim 1, wherein the ignition tips are formed of the different material continuously from their upper side to their lower side.

6. The corona ignition device according to claim 1, wherein the ignition tips are wedge shaped and have at least two converging cut edges on an upper side of the ignition head and at least two converging cut edges on a lower side of the ignition head.

7. An ignition head for a corona ignition device, comprising:

a main body formed from sheet metal formed of a first material; and a plurality of ignition tips formed of a second material and arranged on a narrow side of the main body, wherein each ignition tip together with an adjacent section of the main body forms a wedge delimited by two cut edges that each extend continuously along the entire length of the tip and along an adjacent section of the main body, and whereby the ignition head is cut from a semifinished product assembled from two different materials.

8. A method for producing an ignition head for a corona ignition device, comprising:

providing a sheet metal formed from a first material, the sheet metal having a narrow side at an edge region;

producing a semifinished product by applying a second material to the narrow side of the sheet metal;

then cutting from the semifinished product an ignition head having a main body formed of the first material and ignition tips comprising the narrow side coated with the second material.

9. The method according to claim 8, wherein the narrow side is a side face of the sheet metal.

10. The method according to claim 9, wherein the second material is fastened in the form of a strip to the side face of the sheet metal.

11. The method according to claim 8, wherein the thickness of the semifinished product is reduced before the ignition head is cut.

12. The method according to claim 8, wherein the second material is fastened to the sheet metal by welding.

13. The method according to claim 8, further comprising applying a layer formed from a third material before the application of the second material to the narrow side of the sheet metal.

14. The corona ignition device of claim 2, wherein the two converging cut edges form the apex of the ignition tip.

15. The corona ignition device of claim 2, wherein the two converging cut edges define a wedge.

16. The corona ignition device of claim 1, wherein the cut edges are substantially straight.

17. The corona ignition device of claim 7, wherein the two cut edges converge near the apex of the ignition tips.

18. The corona ignition device of claim 7, wherein the two cut edges are substantially straight.

* * * * *